US007290365B1

(12) United States Patent
Plutsky

(10) Patent No.: US 7,290,365 B1
(45) Date of Patent: Nov. 6, 2007

(54) 12×12 PHOTOGRAPH INSERT PAGE

(75) Inventor: Sheldon Plutsky, Chatsworth, CA (US)

(73) Assignee: Pioneer Photo Albums, Inc., Chatsworth, CA (US)

( * ) Notice: Subject to any disclaimer, the term of this patent is extended or adjusted under 35 U.S.C. 154(b) by 0 days.

(21) Appl. No.: 10/323,481

(22) Filed: Dec. 18, 2002

(51) Int. Cl.
*A47G 1/06* (2006.01)

(52) U.S. Cl. ..... 40/765; 537/661; 281/38

(58) Field of Classification Search ..... 40/405, 40/530, 531, 532, 535, 536, 537, 765, 776, 40/124.2, 661; 281/38; 402/79; D19/32, D19/33
See application file for complete search history.

(56) References Cited

U.S. PATENT DOCUMENTS

| | | | | |
|---|---|---|---|---|
| 875,545 A | | 12/1907 | Macdonald | |
| 1,691,049 A | | 11/1928 | Douglas | |
| 1,889,420 A | | 11/1932 | Rubicam, Jr. | |
| 1,988,998 A | | 1/1935 | Cornish | |
| 2,093,160 A | | 9/1937 | Steinthal | |
| 2,421,503 A | | 6/1947 | Hermon | |
| 2,986,144 A | | 5/1961 | Shepard | |
| 3,245,166 A | | 4/1966 | Hagner | |
| 3,555,713 A | | 1/1971 | Leinbach | |
| 3,596,393 A | | 8/1971 | Lithgow | |
| 3,651,591 A | | 3/1972 | Woodyard | |
| 3,956,836 A | | 5/1976 | Seaborn | |
| 4,247,999 A | | 2/1981 | Latino | |
| 4,263,357 A | * | 4/1981 | Holson | 428/138 |
| 4,356,649 A | | 11/1982 | Diamond et al. | |
| 4,405,228 A | | 9/1983 | Muscoplat | |
| 4,447,973 A | | 5/1984 | Wihlke | |
| 4,458,435 A | | 7/1984 | Ackerman | |
| 4,468,053 A | | 8/1984 | Bradley | |
| 4,965,948 A | * | 10/1990 | Ruebens | 40/537 |
| 5,301,445 A | * | 4/1994 | Hoffmeister | 40/537 |
| 6,027,140 A | * | 2/2000 | Plutsky | 281/38 |
| 6,135,663 A | * | 10/2000 | Tan | 402/79 |
| 6,253,475 B1 | * | 7/2001 | Ruebens | 40/537 |
| 6,266,907 B1 | * | 7/2001 | Matteau et al. | 40/776 |
| 6,474,010 B1 | * | 11/2002 | Hwang | 40/776 |
| 6,601,327 B2 | * | 8/2003 | Ruebens | 40/537 |

FOREIGN PATENT DOCUMENTS

| | | | | |
|---|---|---|---|---|
| DE | 534428 | | 9/1931 | |
| GB | 2030073 A | | 4/1980 | |
| JP | 5-201188 | * | 5/1993 | 40/537 |

OTHER PUBLICATIONS

Translation of Japanese Reference 5-201188.*

* cited by examiner

*Primary Examiner*—Gary C. Hoge
(74) *Attorney, Agent, or Firm*—Jeffer Mangels Butler & Marmaro LLP

(57) ABSTRACT

A photo album insert including a sheet of material; and a transparent cover overlaying the sheet, resulting in a generally rectangular sandwich, the sandwich having an upper edge, a bottom edge and a side edge, the side edge being sealed such that a sealed portion of the side edge extends no more than half an inch from the side edge.

18 Claims, 4 Drawing Sheets

12×12 PHOTOGRAPH INSERT PAGE

FIELD OF THE INVENTION

The present invention concerns devices for the storage and display of photographs and the like, and more particularly to photo albums.

BACKGROUND OF THE INVENTION

Devices for the storage and display of photographs and the like have taken many forms. One form, commonly referred to as a photograph album, comprises a plurality of bound leaves disposed within an outer cover with photographs or similar objects mounted on the two planar surfaces, or display pages, of each leaf. The leaves within the photograph album are commonly made of either a stiff cardboard material or a flexible transparent plastic. In the latter instance, two sheets of transparent plastic are bound together to form a plurality of pockets into which photographs are inserted.

A number of means for mounting photographs on the album pages are employed with cardboard-type leaves. One of the most common mounting means involves taping or gluing the photographs to the display pages. Another common mounting means involves a small adhesive-backed device, called a "corner," having a triangular-shaped pocket to receive a corner edge of a photograph. Typically four "corner" devices are disposed over the corner edges of a photograph and retained on the display page by the adhesive backing on the "corner" device.

All of these adhesive mounting means suffer from a similar defect in that the adhesives employed dry out with the passage of time, enabling the photographs to fall out of the album. These mounting means further discourage the replacement of photographs mounted in an album since removal frequently damages or defaces the photograph and/or the display page.

Another mounting means employed in conjunction with cardboard-type leaves involves coating the entire album page with an adhesive substance which retains the photographs on the album page. A transparent plastic sheet is attached to the album page to cover the photographs and the album page and prevent adjacent album leaves from adhering together. While this approach does provide a good mount, it fails to provide a convenient "memo" area on which to place information pertinent to the stored photographs. The adhesive used in this approach can also change over time, either increasing the risk of damage to the photo when removed or allowing the photo to fall from the album.

The use of transparent plastic album leaves also suffers from a number of disadvantages. For example, the size and orientation of the album pockets are constant. An album designed to store and display a particular size photograph cannot store photographs in a larger format as may be subsequently offered by photograph film developing businesses. Photograph orientation is important since most commercially available photographs have a rectangular shape with the image displayed on the photograph usually having an obvious vertical (i.e., "up-and-down") orientation. The vertical orientation of the photograph may coincide with the longer longitudinal axis of the photograph or the shorter latitudinal axis, depending upon the orientation of the camera when the photograph was taken. Photographers will occasionally orient a camera sideways to avail themselves of advantageous picture framing situations. The photographer thus develops a collection of photographs having both longitudinal and lateral vertical orientations. Prior art transparent plastic album leaves typically provide only a single longitudinal or latitudinal vertical orientation, thus limiting the photographer's framing choices. While a few prior art transparent plastic album leaves have been produced with album pockets having both longitudinal and latitudinal vertical orientations, the number of album pockets per leaf with each orientation is constant and transparent plastic album leaves of this type cannot permit both longitudinal and latitudinal vertical orientation within the same area on a single album page. To avoid wasting album space, the photographer is constrained to having the remaining space in his album dictate the framing orientation of his photographic composition.

Transparent plastic album leaves also fail to provide a convenient memo area. Pertinent information may be written on the back of the photograph, but only at the risk of damaging the photograph since the writing ink may seep through to the image side of the photograph. Further, use of the back side of the photograph as a memo area reduces the number of photographs that may be conveniently stored in each leaf.

Moreover, the standard album leaves that are currently used to display large format photos such as those that are 4-inch by 12-inch in size, have disadvantages as the album leaves, generally referred to as "12-inch by 12-inch" (or "12×12") leaves, are constructed such that they do not have enough space in the pockets to allow the pictures to be inserted without bending or wrinkling the photograph or its edges. The size of these album leaves are typically constrained as the album leaves have to fit within a standard format photo album.

Thus, there exists a need for a more versatile photo album permitting the bi-direction storage and display of photographs on the same portion of a display page without employing an adhesive mounting means which also includes a convenient information memo area. In addition, there also exists a need for album leaves that are capable of bi-directional storing and display of photographs of a large format without need for the user to fold or otherwise damage the photograph during the insertion process.

SUMMARY OF THE INVENTION

In accordance with the present invention, there is provided an improved device for the storage and display of photographs and the like, i.e., an improved photo album. The improved bidirectional photo album of the present invention permits display of either longitudinal or latitudinal vertically oriented photographs on the same area of an album display page. Further, photographs may be easily inserted and replaced over any period of time without damaging either the album page or the photograph. Moreover, photographs will not slip out of the album regardless of the album orientation. Finally, a memo area is also provided on each display page for the recordation of information pertinent to adjacently stored photographs. An index sheet provides quick reference to the display page on which a particular photograph or like object is stored.

According to the preferred embodiment, the bi-directional photo album of the present invention comprises a plurality of bound leaves and an index sheet disposed within and coupled to an outer cover. A transparent cover is attached to three edges of each display page of each album leaf. Orientation ribs formed by lines of attachment between the transparent cover and the display page provide for the adjacent display of either several latitudinal vertically oriented photographs or a latitudinal vertically oriented photograph and a longitudinal vertically oriented photograph or two longitudinal vertically oriented photographs on the same display page. A writing surface is provided on each display page for recordation thereon of information pertinent to an adjacently stored photograph.

According to another preferred embodiment, each display page of the photo album is sealed close to the edges of the display page to provide enough space for the insertion of a large format photograph while minimizing the risk of damage to the photograph.

The novel features which are believed to be characteristic of the invention, together with further objectives and advantages thereof, will be better understood from the following description considered in connection with the accompanying drawings in which a presently preferred embodiment and an alternate embodiment of the invention are illustrated by way of example. It is to be expressly understood, however, that the drawings are for the purpose of illustration and description only, and are not intended as a definition of the limits of the invention.

DETAILED DESCRIPTION OF THE INVENTION

Figure 1:
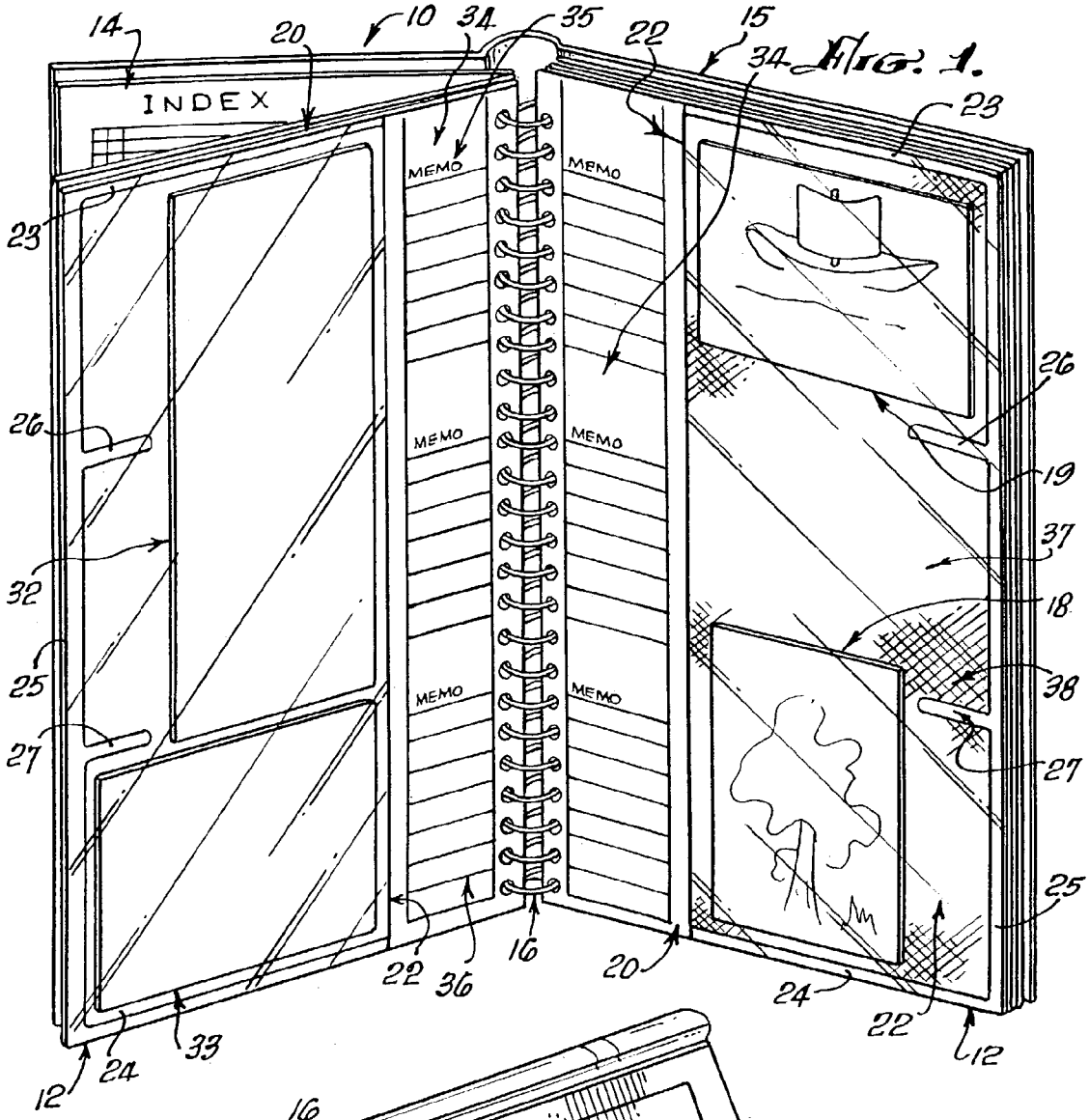
FIG. 1 is a perspective view of a preferred embodiment the invention.

Referring now to the drawings, and more particularly to FIG. 1 thereof, there is shown a preferred embodiment of a bidirectional album, generally designated 10, of the present invention. The bidirectional album 10 includes a plurality of leaves 12 and an index sheet 14 disposed within an outer cover 15 and bound together by a binding means 16 which is attached to the outer cover 15. Each album leaf 12 has two oppositely directed planar surfaces, or display pages, generally designated as 20, on which photographs 18 and 19 and like objects are stored and displayed. A transparent cover 22 is disposed adjacent and attached to a portion of each display page 20 so as to form a pocket. Photographs 18 and 19 are stored beneath the transparent cover 22. The index sheet 14 is provided for recordation thereon information pertinent to the location of a particular photograph within the bi-directional album 10. This index sheet 14 provides a simple and convenient method of accessing a particular photograph stored on a particular display page.

Figure 2:
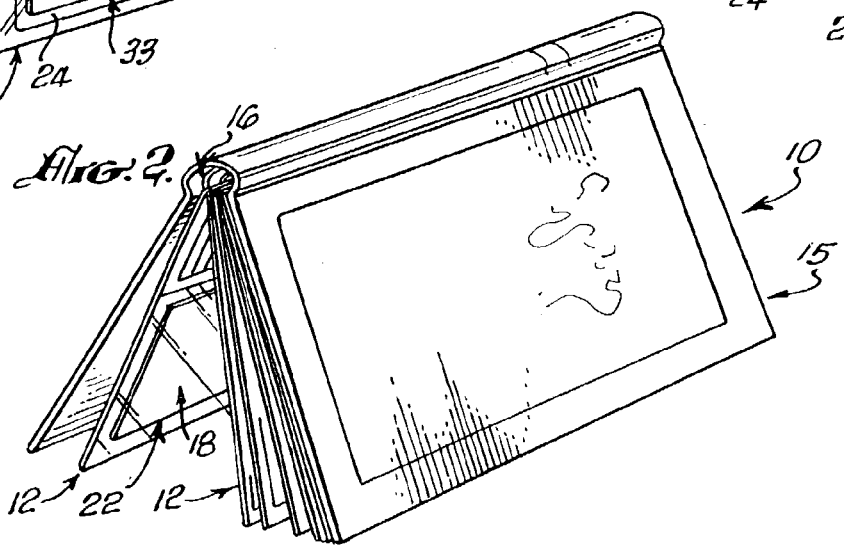
FIG. 2 is a further perspective view in which a preferred embodiment of the present invention has been opened to show opposing display pages of two adjacent album leaves.
Figure 3:
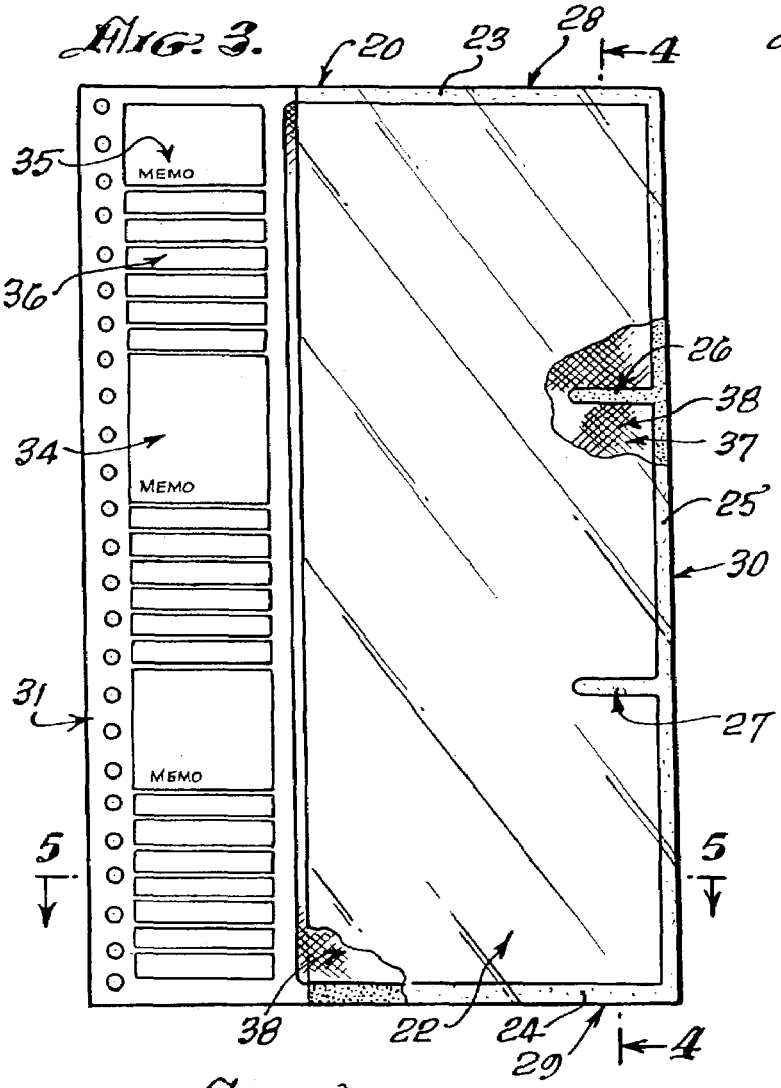
FIG. 3 is a detailed view of a display page of an album leaf of a preferred embodiment of the present invention.
Figure 4:
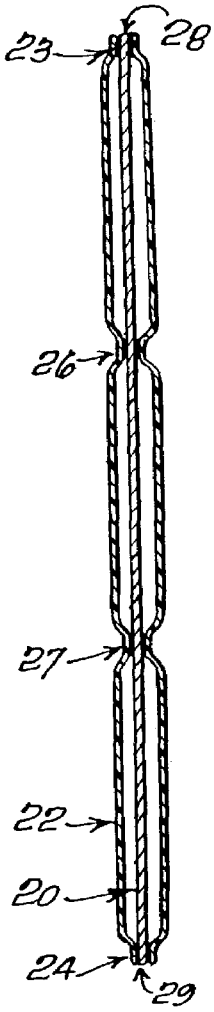
FIG. 4 is a cross-sectional view of an album leaf of a preferred embodiment of the present invention taken along line 4-4 in FIG. 3.
Figure 5:
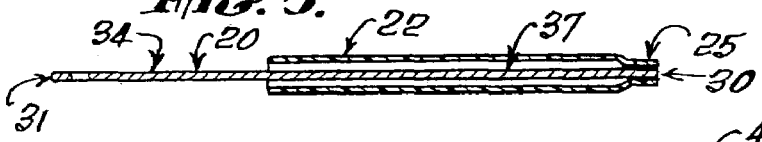
FIG. 5 is a cross-sectional view of an album leaf of a preferred embodiment of the present invention taken along line 5-5 in FIG. 3.

As shown in FIGS. 3 through 5, the transparent cover 22 is attached to the display page 20 along various lines of attachment generally designated as 23 through 27. The transparent cover 22 may be attached to the display page 20 by any convenient means such as, for example, various well-known types of adhesives. Attachment lines 23 and 24 are disposed adjacent lateral album leaf edges 28 and 29. A third attachment line 25 is disposed adjacent an album leaf edge 30 opposite an album leaf edge 31 engaging the binding means 16. This arrangement prevents the photographs from slipping out of the bi-directional album 10 when the album 10 is oriented as shown in FIG. 2. Two transverse lines of attachment further affix the transparent cover 22 to the display page 20 so as to form two orientation ribs 26 and 27.

The orientation ribs 26 and 27 are in spaced relationship approximately the same distance from one another and the attachment lines 23 and 24 adjacent the lateral album leaf edges 28 and 29. The orientation ribs 26 and 27 are approximately parallel to the attachment lines 23 and 24 and extend from the attachment line 25 adjacent the album leaf edge 30 towards the album leaf edge 31 engaging the binding means 16. The length of the orientation ribs 26 and 27 should not exceed, approximately, the difference between the longitudinal and latitudinal measurements of the largest photograph 32 to be stored in the bidirectional album 10.

The length, orientation, and location of the orientation ribs 26 and 27 permit adjacent storage of either latitudinal or longitudinal vertically oriented photographs on the same portion of the display pages 20 of the present invention. Thus, three latitudinal vertically oriented photographs having the same orientation as photograph 19 in FIG. 1 or two longitudinal vertically oriented photographs having the same orientation as photograph 18 or a combination of a latitudinal and a longitudinal vertically oriented photograph, as shown in FIG. 1 with photographs 18 and 19, may be stored on the same display page 20. Adhesives are not required to retain photographs and the like on the display page 20. The orientation ribs 26 and 27 secure the transparent cover 22 in sufficient proximity to display page 20 to effectively retain latitudinal vertically oriented photographs of maximum dimensions, such as photograph 33 in FIG. 1, between the orientation ribs 26 and 27. Longitudinal vertically oriented photographs of maximum dimensions, such as photograph 32, are effectively retained adjacent the orientation ribs 26 and 27. Photographs having dimensions less than the dimensions of the largest photographs to be stored in the bidirectional album 10 may also be conveniently stored within the album without the use of adhesives. Consequently, photographs and the like may be removed and replaced throughout the useful life of the bi-directional album 10 without risk of damage to either the stored photographs or the display page 20.

It should be understood that a greater or lesser number of orientation ribs may be included, depending on the number and size of photographs and the like to be stored on the display page 20, without departing from the spirit of the invention. Similarly, the length of the orientation ribs will vary depending on the maximum size of photographs intended for storage in the bi-directional album 10.

As shown in FIGS. 3 and 5, the transparent cover 22 is disposed over only a portion of the display page 20 surface.

A writing surface 34 is provided on the uncovered portion of display page 20 adjacent album leaf edge 31 for the recordation of information pertinent to an adjacently stored photograph. This writing surface 34 obviates the need to record pertinent information on the rear surface of the photograph. The writing surface 34 may have imprinted thereon various indicia 35 and 36 to facilitate the recordation of information.

The surface area 37 of the display page 20 covered by the transparent cover 22 also has imprinted thereon contrasting indicia 38 for aesthetic purposes. As shown in FIG. 1, the contrasting indicia 38 are partially obscured by photographs and the like stored on the display page 20.

Numerous alterations could be introduced without departing from the spirit of the invention. For example, the writing surface 34 shown adjacent the album leaf edge 31 engaging the binding means could be located adjacent the opposing album leaf edge 30. Various types of binding means 16 could be employed, for example, engaging the album leaves 12 in a greater or lesser number of locations. A binding means permitting the insertion and removal of album leaves 12 from the album could also be employed. A greater number of orientation ribs could be included and disposed substantially as disclosed above for storage of a greater number of photographs.

Figure 6:
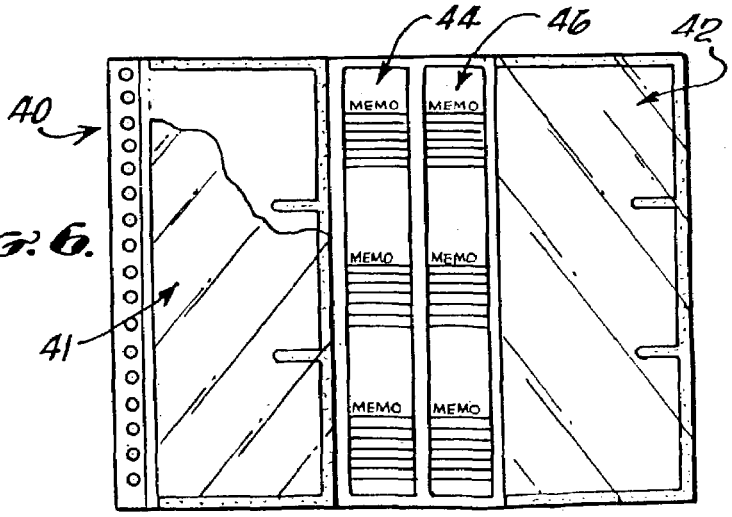
FIG. 6 is a detailed view of a display page of an album leaf of an alternate embodiment of the present invention.

In an alternate embodiment of the present invention, shown in FIG. 6, a display page 40 has two transparent panels 41 and 42 attached in the manner disclosed above. Two adjacent writing surfaces 44 and 46 are provided in the middle of the display page 40, between the transparent panels 41 and 42.

In a still further embodiment, two transparent panels and two writing surfaces could be provided on each page in an alternating arrangement, having a writing surface disposed adjacent an album leaf edge engaging a binding means and, adjacent thereto, a transparent cover followed thereafter by a second writing surface followed by a second transparent cover.

Figure 7:
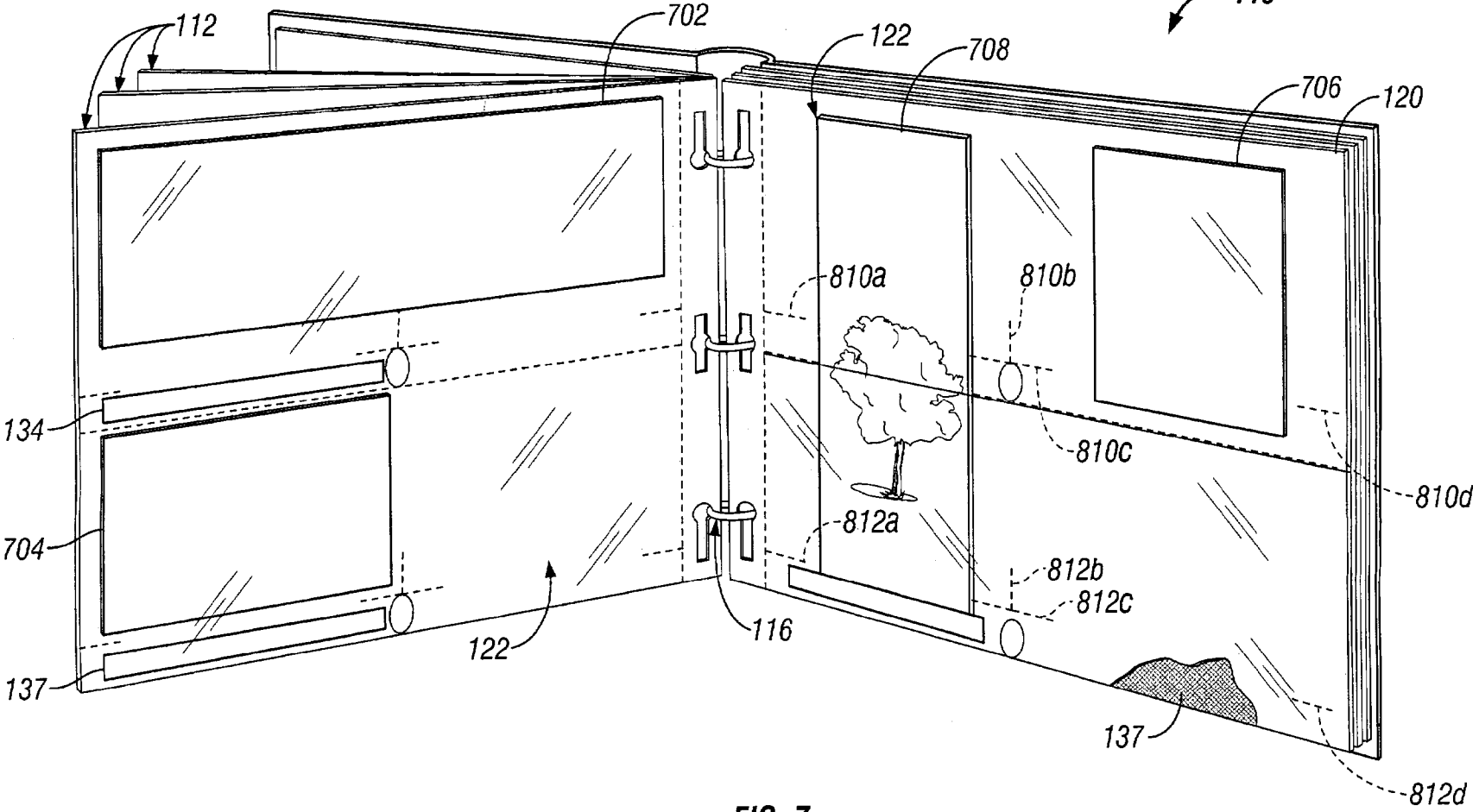
FIG. 7 is a perspective view in which an alternate embodiment of the present invention has been opened to show opposing display pages of two adjacent album leaves.
Figure 9:
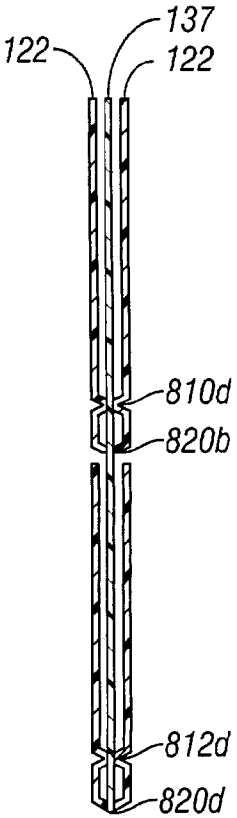
FIG. 9 is a cross-sectional view of an album leaf of a preferred embodiment of the present invention taken along line 9-9 in FIG. 8; and, FIG. 10 is a cross-sectional view of an album leaf of a preferred embodiment of the present invention taken along line 10-10 in FIG. 8.
Figure 8:
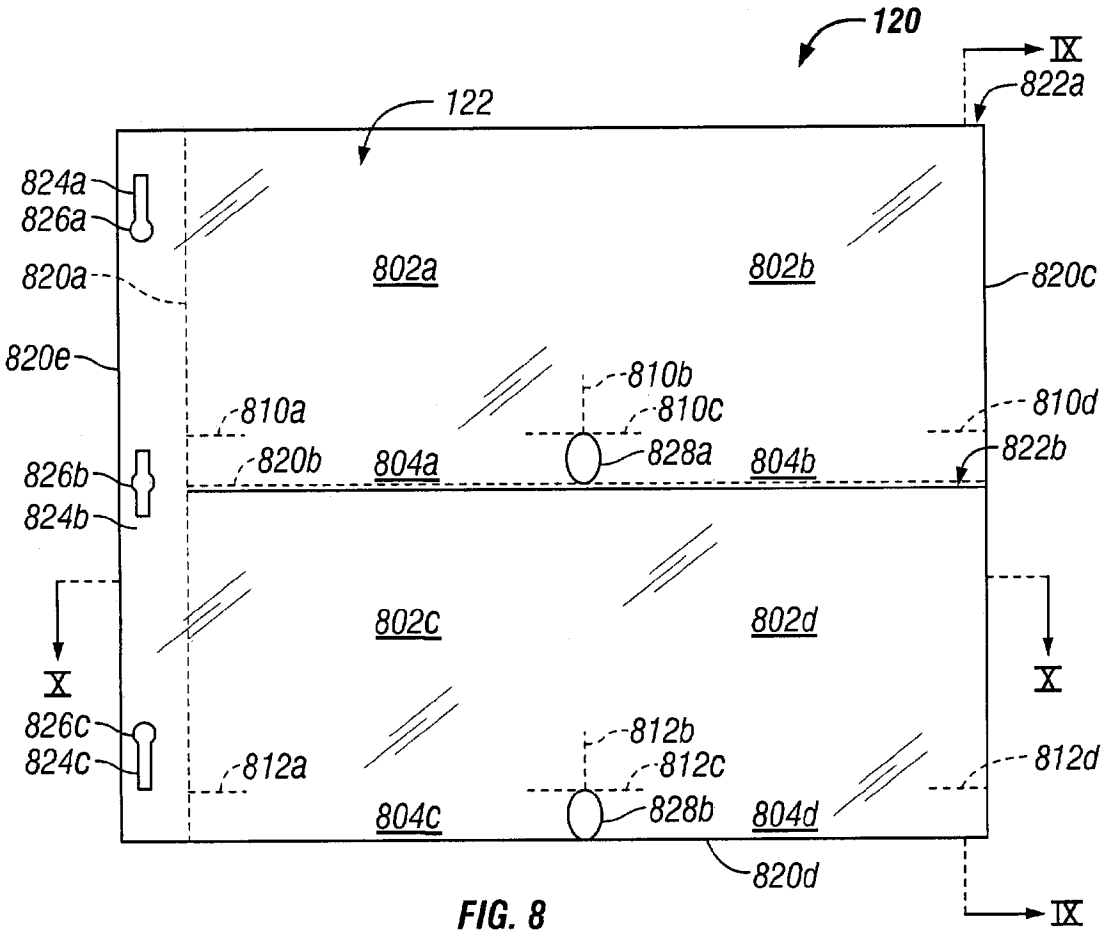
FIG. 8 is a detailed view of a display page of an album leaf of a preferred embodiment of the present invention.
Figure 10:
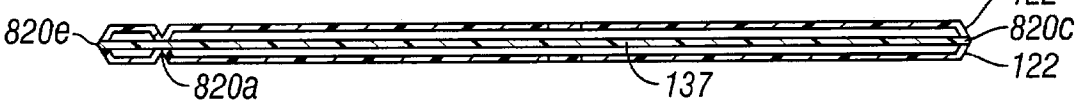

FIG. 7 is a perspective view in which an alternate embodiment of album 10, generally referred to as a large format album 110, includes a plurality of large format leaves 112 bound by a binding means 116. Large format album 110 has been opened to show two opposing display pages 120 of two adjacent large format album leaves 112. FIGS. 8-10 will be used along with FIG. 7 in the following description.

As discussed herein, a variety of binding means 116 may be used with album leaves 112. In a preferred embodiment, a plurality of slots and a plurality of holes, generally designated as 824*a-c* and 826*a-c*, respectively, are located on each album leaf. Each slot and hole combination, together generally referred to as a keyhole, allows the album leaves to be used in a variety of binders. The keyhole, along with other embodiments of the hole and slot combination that is functionally equivalent, is further described in U.S. Pat. No. 6,027,140, entitled PHOTOGRAPH ALBUM PAGE INSERT, commonly owned by the Assignee of the present invention, the entire disclosure of which is expressly incorporated herein by reference.

Similar to each album leaf 12, each album leaf 112 has two oppositely directed planar surfaces, or display pages, generally designated as 120. Display page 120, also referred to as a "12-inch by 12-inch insert" or "12×12 insert" page, includes a transparent cover 122 attached to surface area 137 through a plurality of sealed edges and/or attachment lines. The 12×12 insert page offers bidirectional picture storage capability for both regular format photographs up to 4-inches by 6-inches ("4×6") and large (e.g., panoramic) format photographs up to 4-inches by 12-inches ("4×12"). These pages are in a format compatible with industry standard 12×12 pages and are also compatible with a variety of binding means. In addition, in another preferred embodiment, the pages may be adapted to fit pictures of other sizes, such as a 3-inches by 5-inches ("3×5") picture, which may have large formats of up to 3-inches by 10-inches ("3×10").

In the preferred embodiment of the large format display page 120, each album leaf 112 is virtually seamlessly sealed along a plurality of edges and sealed attachment lines designated by 820*a*, 820*b*, 820*c*, 820*d* and 820*e*. In a preferred embodiment, the seal is formed no more than a half an inch from the edges of the album leaf using a heat seal or other suitable sealing means such as glue or other fasteners. In a more preferred embodiment, the seal is formed no more than one third of an inch from the edges of the album leaf. In an even more preferred embodiment, the seal is formed no more than one quarter of an inch from the edges of the album leaf. In the most preferred embodiment, the seal is formed no more than one eighth of an inch from the edges of the album leaf.

The space between attachment line 820*a* and sealed edges 820*b* and 820*c* is split into pockets designated by 802*a*, 802*b*, 804*a* and 804*b*, while the space between attachment line 820*a* and sealed edges 820*c* and 820*d* is split into pockets designated by 802*c*, 802*d*, 804*c* and 804*d*. Pockets 802*a-d* may be used to hold photographs, while pockets 804*a-d* are used to hold strips of paper or other materials with a writable surface, generally designated as 134. In another embodiment, the portion of transparent cover 122 covering pockets 804*a-d* may include a writable surface, which may be opaque.

Pockets 802*a* and 802*b* are accessible by an opening 822*a* between transparent cover 122 and surface area 137, while pockets 802*c* and 802*d* are accessible by an opening 822*b* between transparent cover 122 and surface area 137. In the embodiment shown in FIG. 8, both openings 822*a* and 822*b* run the length of pockets 802*a* and 802*b*. In another embodiment, openings 822*a* and 822*b* may be partially sealed at the edges of the opening, thereby helping to retain the photographs inserted into pockets 802*a-d*. In one preferred embodiment, the longest edge of the pocket and edge of the display sheet should be within the range of 11 inches to 13 inches. In a more preferred embodiment, the longest edge of the pocket and edge of the display sheet should be within the range of 11.5 to 12.5 inches. In the most preferred embodiment, the longest edge of the pocket is approximately 12 inches, with the additional length of the edge of the display sheet being of a size necessary for the placement of the keyholes for mounting the display sheets in binders.

In the past, the edges of an album leaf have not been seamless (i.e., they have been heat sealed, with the seals on the display surface of the album leaf), with the result being that the pockets created in these album leaves were small. By reconfiguring the album leaves to place the seal on the edges of each album leaf, the space provided for the display of photographs is significantly increased. Previously, without the extra space, pictures would have to be wrinkled to fit into the pockets. In the preferred embodiment, the seals are placed on the edges of album leaf 112 (i.e., sealed edges 820*b* and 820*d*)—i.e., creating a seamless attachment of transparent cover 122 to album leaf 112. By not placing the seal within the boundaries of the display area of album leaf 112, enough space in the pockets is created for a 12-inch wide panoramic picture to be held. Thus, album leaves 112 provides the maximum amount of space for storing photos in the pockets.

Referring to FIG. 8, a plurality of orientation ribs, generally designated as 810, are located on display page 120. In one embodiment, orientation ribs 810 are created by a series of attachments formed by heat seals to seal transparent cover 122 to surface area 137. The seals in this embodiment may be formed such that both sides of display page 120 is formed at the same time—i.e., two transparent are placed in a position to sandwich the display page and the heat seals are created on both sides simultaneously.

Two adjacent latitudinal vertically oriented 4×6 (landscape) photographs having the same orientation as photographs 704 may be placed in each row of display sheet 120, with the photographs separated by vertical orientation rib 810*b* (or 812*b*) and held up with horizontal orientation rib 810*a*, 810*c* and 810*d* (or 812*a*, 812*c*, or 812*d*). Thus, a photograph in an orientation as photograph 704 may be placed in each pockets 802*a-d*. Alternatively, one 4×12 latitudinal vertically (landscape) oriented photograph having the same orientation as photograph 702 may be placed in each row of display sheet 120, supported by vertical orientation rib 810*b* (or 812*b*). Thus, as shown in FIG. 7, photograph 702 may be placed in the space provided by pockets 802*a* and 802*b*. In addition, photograph 702 may be placed in the space provided by pockets 802*c* and 802*d*.

Moreover, two 4×12 longitudinal vertically oriented (portrait) photographs having the same orientation as vertically oriented photograph 708 may be placed in display sheet 120, in pocket 802*c* and 802*d*, in which case pockets 802*a* and 802*b* would be obstructed. Further still, 4×6 longitudinal vertically oriented (portrait) photographs having the same orientation as vertically oriented photograph 706 may be placed in each pockets 802*a-d*.

From the foregoing, it is believed that the invention may be readily understood by those skilled in the art without further description. As discussed above, numerous changes may be made in the details disclosed without departing from the spirit of the invention, as set forth in the claims below.

What is claimed is:

1. A photo album insert comprising:

a sheet of material;

a transparent cover overlaying the sheet of material, resulting in a generally rectangular multi-layered structure, the multi-layered structure having an upper edge, a bottom edge, a side edge and a sealed portion, wherein the transparent sheet is sealed to the sheet of material along the sealed portion, and wherein the sealed portion is located no more than half an inch from the side edge, the transparent cover including at least one horizontal attachment line located half-way between the upper edge and the bottom edge, the at least one horizontal attachment line attaching the transparent cover to the sheet of material;

a plurality of horizontal orientation ribs;

at least two vertical orientation ribs;

wherein the horizontal orientation ribs and the at least two vertical orientation ribs define a plurality of pockets; and a picture area located above the at least one horizontal attachment line, the picture area being of a size to hold a first picture with a first picture height and a first picture width, the first picture height being shorter than the first picture width when the first picture is oriented in a landscape format, the picture area including one of the vertical orientation ribs dividing the picture area into two areas, each being of a size to hold a second picture with a second picture height and a second picture width, the second picture height being shorter than the second picture width when the second picture is oriented in the landscape format, the second picture width being shorter than the first picture width and the second picture height being longer than the first picture height, the vertical orientation rib being located from the side edge at a distance at least as long as the second picture width, and the vertical orientation rib being spaced from the top edge a distance equal to or greater than the first picture height.

2. The photo album insert of claim 1, where the sealed portion is located no more than a quarter of an inch from the side edge.

3. The photo album insert of claim 1, where the sealed portion is located no more than an eighth of an inch from the side edge.

4. The photo album insert of claim 1, where the sealed portion is on the side edge.

5. The photo album insert of claim 1, where the upper edge has a length that ranges from 11 inches to 13 inches.

6. The photo album insert of claim 1, where the upper edge has a length that ranges from 11.5 inches to 12.5 inches.

7. The photo album insert of claim 1, where the upper edge has a length that is approximately 12 inches.

8. The photo album insert of claim 1, wherein the plurality of pockets are configured to hold two 4-inch by 12-inch photographs in one of a latitudinal orientation and a longitudinal orientation.

9. The photo album insert of claim 1, comprising a plurality of keyholes for mounting the display sheet in a photo album.

10. The photo album insert of claim 9, further comprising:

at least two circular mounting holes; and, at least two rectangular mounting holes.

11. The photo album insert of claim 10, wherein at least one of the circular mounting holes is adjoined to one of the rectangular mounting holes.

12. A photo album insert comprising:

a display sheet having means for holding two 4 inch by 12-inch photographs in one of a latitudinal orientation and a longitudinal orientation, wherein said means includes at least one horizontal attachment line, a plurality of horizontal orientation ribs, and at least two vertical orientation ribs, wherein the horizontal orientation ribs and the at least two vertical orientation ribs define a plurality of pockets, and wherein one of the vertical orientation ribs is located from a side edge of the display sheet a distance equal to or greater than 6 inches and from a top edge of the display sheet equal to or greater than 4 inches; and, a seal located no more than half an inch from a side edge of the display sheet.

13. The photo album insert of claim 12, where the seal is located on the side edge.

14. The photo album insert of claim 12, the display sheet further including means for holding four 4-inch by 6-inch photographs, wherein each photograph is in one of a latitudinal orientation and a longitudinal orientation.

15. The photo album insert of claim 12, further comprising a plurality of keyholes for mounting the display sheet in a photo album.

16. The photo album insert of claim 15, the plurality of keyholes further comprising:

at least two circular mounting holes; and, at least two rectangular mounting holes.

17. The photo album insert of claim 16, wherein at least one of the circular mounting holes is adjoined to one of the rectangular mounting holes.

18. A photo display page comprising:

a base sheet;

a transparent sheet attached to the base sheet;

a plurality of seals for defining a space for holding a large format photograph in one of a landscape position and a portrait position, wherein the large format photograph comprises a long side length and a short side length and wherein the plurality of seals also define an opening to allow the easy insertion of the large format photograph into the space;

a plurality of orientation ribs to allow a short format photograph having a long side length shorter than the long side length of the large format photograph but also having a short side length longer than the short side length of the large format photograph to be stored in one of a landscape position and a portrait position in the space; and wherein the plurality of orientation ribs comprise a plurality of horizontal orientation ribs and a plurality of vertical orientation ribs, wherein the horizontal orientation ribs and the vertical orientation ribs define a plurality of pockets, and wherein one vertical orientation rib is spaced from a top edge of the transparent sheet, and wherein a short format photograph can be stored between the at least one vertical orientation rib and either side edge of the transparent sheet.

* * * * *